US011913653B2

(12) United States Patent
Lanthier

(10) Patent No.: US 11,913,653 B2
(45) Date of Patent: Feb. 27, 2024

(54) COVER ASSEMBLY FOR A CONDENSER UNIT MOUNTED TO A STAND AND METHOD FOR INSTALLING THE SAME

(71) Applicant: INNOPRO HVAC INC, Saint-Hubert (CA)

(72) Inventor: François Lanthier, Carignan (CA)

(73) Assignee: INNOPRO HVAC INC., Saint-Hubert (CA)

( * ) Notice: Subject to any disclaimer, the term of this patent is extended or adjusted under 35 U.S.C. 154(b) by 0 days.

(21) Appl. No.: 18/139,544

(22) Filed: Apr. 26, 2023

(65) Prior Publication Data

US 2023/0375197 A1 Nov. 23, 2023

Related U.S. Application Data

(60) Provisional application No. 63/343,139, filed on May 18, 2022.

(51) Int. Cl.
*F24F 1/58* (2011.01)
*F24F 13/32* (2006.01)

(52) U.S. Cl.
CPC ..... *F24F 1/58* (2013.01); *F24F 13/32* (2013.01)

(58) Field of Classification Search
CPC ..... F24F 1/58; F24F 1/56; F24F 13/20; F24F 13/32
See application file for complete search history.

(56) References Cited

U.S. PATENT DOCUMENTS 2,914,075 A * 11/1959 Wells ..... F24F 1/04 62/331
4,730,423 A * 3/1988 Hughes ..... E04H 15/003 52/27
5,655,382 A * 8/1997 Chen ..... F24F 1/58 53/472
9,435,561 B2 9/2016 Bowen
10,294,684 B1 * 5/2019 Shedd ..... F24F 1/60
(Continued)

FOREIGN PATENT DOCUMENTS

CN 207702618 8/2018
CN 110410884 11/2019
(Continued)

OTHER PUBLICATIONS

Outdoor Window Air Conditioning Cover (China), https://www.amazon.ca/Conditioning-Waterproof-Suitable-Condenser-Compressor/dp/B08HK4BL5V.
(Continued)

*Primary Examiner* — Joseph F Trpisovsky
(74) *Attorney, Agent, or Firm* — NORTON ROSE FULBRIGHT CANADA LLP

(57) ABSTRACT

A cover assembly for a condenser unit mounted to a stand includes a base connectable to the stand, a column extending upwardly from the base, the column having a lower portion and an opposite upper portion, the lower portion being connectable to the base, a cover connectable to the upper portion of the column, the cover extending above the condenser unit and being shaped and dimensioned for spanning at least partially over the condenser unit, and a leg projecting from the cover for abutting a wall of the condenser unit, the leg being spaced from the column. A method for installing a cover assembly on a condenser unit mounted to a stand is also described.

20 Claims, 9 Drawing Sheets

(56) References Cited

U.S. PATENT DOCUMENTS

| | | | |
|---|---|---|---|
| 11,226,121 | B1 | 1/2022 | Hornbacher |
| 2017/0074526 | A1 | 3/2017 | Colantuoni et al. |

FOREIGN PATENT DOCUMENTS

| | | | | | |
|---|---|---|---|---|---|
| CN | 215808927 | | 2/2022 | | |
| JP | H11159809 | | 6/1999 | | |
| KR | 20030008482 | A * | 1/2003 | ..... | F24F 1/58 |
| WO | WO-2008071811 | A1 * | 6/2008 | ..... | F24F 1/58 |

OTHER PUBLICATIONS

Mini Split & Heat Pump Covers (USA), https://www.cover-tech.com/heat-pump-covers.
Heat Pump Snow Covers (Canada), https://www.greenfootenergy.ca/heat-pump-snow-covers-protect-your-investment.
Mini-Split Heat Pump Cover (Canada), https://www.heatpumpcover.ca/.
Air Conditioner Cover (France), https://www.almateon.com/cache-climatiseur/234568933-cache-climatiseur-132-x-58-x-147-cm-et-pompe-%C3%A0-chaleur-en-bois-%C3%A9pic%C3%A9a-xl-trait%C3%A9-tht-habrita-foresta.html?id_product=234568933.
Air Conditioner Cover (USA), https://airdeko.com/.
Heat Pump Cover (France), http://m.fr.rebosschina.com/heat-pump-canopy/heat-pump-cover.html.
Heat Pump Cover (Canada), https://www.heatpumpshelters.com/.
Weatherguard (Canada), https://fr.airfiltration.ca/pages/weatherguard.
Air Conditioner Roof (France), https://www.amifrigo.com/toiture-de-climatiseur.html.
Sleeve Wall AC (Canada), https://www.grainger.ca/en/product/p/WWG5PP42?cm_mmc=PPC:+Google+PLA&ef_id=EAlalQobChMliaOyprzw9gIV5z2tBh1thAjOEAQYBSABEglYnfD_BwE:G:s&s_kwcid=AL!3645!3!483556496832!!!g!545759021711!&gclid=EAlalQobChMliaOyprzw9gIV5z2tBh1thAjOEAQYBSABEglYnfD_BwE&gclsrc=aw.ds.

* cited by examiner

COVER ASSEMBLY FOR A CONDENSER UNIT MOUNTED TO A STAND AND METHOD FOR INSTALLING THE SAME

CROSS-REFERENCE

The present application claims priority to U.S. Patent Application Ser. No. 63/343,139 titled "Cover Assembly For A Condenser Unit Mounted To A Stand and Method For Installing The Same" and filed on May 18, 2022, the contents of which is incorporated-by-reference herein in its entirety.

TECHNICAL FIELD

The present technology relates to cover assemblies for condenser units.

BACKGROUND

There exists a wide variety of condenser units adapted for heat, ventilation and air conditioning systems (HVAC systems) using heat pumps or air conditioning units. The condenser unit is the part of the HVAC system that is adjacent and outside of the building being climate controlled. Working together with the compressor, when the system is in cooling mode it uses the compressor to pressurize the refrigerant into a hot liquid. When the system is in heating mode, the heat pump reverses that process and sends the warm air back into the building as opposed to ejecting the hot air outdoors.

Cover assemblies have been proposed to shelter, at least partially, the condenser unit from snow accumulation, icy rain, debris, and other hazards that can affect the operation or durability of the condenser unit. However, the known cover assemblies have different drawbacks. For example, cover assemblies generally require connection of the cover assembly to the wall that is adjacent to the condenser unit. This configuration makes the installation process more complex, reduces access to the rear of the condenser unit, and may cause airflow restrictions that can affect the performances of the condenser unit.

Therefore, in spite of previous efforts, there seems to be some room for improvement in the art for a cover assembly for a condenser unit that reduces the aforementioned drawbacks.

SUMMARY

In one aspect, there is provided a cover assembly for a condenser unit mounted to a stand, including a base connectable to the stand, a column extending upwardly from the base, the column having a lower portion and an opposite upper portion, the lower portion being connectable to the base, a cover connectable to the upper portion of the column, the cover extending above the condenser unit, the cover spanning at least partially over the condenser unit, and a leg projecting from the cover, the leg being abuttable to a wall of the condenser unit, the leg being spaced from the column, the column defining a first load path between the cover and the stand, the leg defining a second load path between the cover and the condenser unit, and the second load path being different from the first load path.

In some embodiments, the column extends at the rear of the condenser unit.

In some embodiments, the leg is integrally formed with the cover.

In some embodiments, the cover has a bottom face, and the leg projects downwardly from the bottom face of the cover.

In some embodiments, the wall of the condenser unit is a top wall of the condenser unit, and the leg is abuttable to the top wall of the condenser unit.

In some embodiments, the cover has at least one side wall extending vertically below the top wall of the condenser unit.

In some embodiments, the cover assembly further includes a fastener connectable to the leg for connecting the leg to the wall of the condenser unit.

In some embodiments, the fastener is one of a double-sided adhesive tape, an adhesive, a hook and loop fastener, and a magnet.

In some embodiments, the base defines at least one slot, and the cover assembly further includes a base fastener receivable in the at least one slot, the base fastener connecting the base to the stand notwithstanding the condenser unit being mounted to the stand.

In some embodiments, the cover assembly further includes measurement markings provided on the cover for selectively positioning the cover relative to the condenser unit.

In some embodiments, the cover has a top face having a rear portion and a front portion, the rear portion extending vertically higher than the front portion when the cover is connected to the column, and the top face is generally curved downwardly from the rear portion to the front portion.

In some embodiments, the cover defines at least one ridge extending over at least one of a majority of a length of the cover and a majority of a width of the cover.

In some embodiments, the cover is shaped and dimensioned to span over at least one of an entire overall length and an entire overall width of the condenser unit.

In some embodiments, the column has a selectively adjustable height.

In some embodiments, the cover assembly further includes at least one extension tube connectable between the column and the cover.

In another aspect, there is provided a method for installing a cover assembly on a condenser unit mounted to a stand, the method including the steps of connecting a base of the cover assembly to the stand, connecting a column to the base, the column having a lower portion connectable to the base and an opposite upper portion, connecting a cover to the upper portion of the column, and abutting a leg projecting from the cover to a wall of the condenser unit.

In some embodiments, the method further includes connecting the leg to the wall of the condenser unit with a fastener.

In some embodiments, the method further includes selecting a height of the column prior to connecting the cover to the upper portion of the column.

In some embodiments, the method further includes selectively positioning the cover with the condenser unit using measurement markings provided on the cover.

In some embodiments, the method further includes connecting at least one extension tube between the column and the cover.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure generally describes a cover assembly 20 being an embodiment of the present technology. It is to be expressly understood that the cover assembly 20 is merely a preferred embodiment of the present technology. The description thereof that follows is intended to be only a description of a physical example of the technology. This description is not intended to define the scope or set forth the bounds of the technology. In some cases, what are believed to be helpful examples of modifications to the cover assembly 20 are also set forth hereinbelow. This is done merely as an aid to understanding, and, again, not to define the scope or set forth the bounds of the technology. These modifications are not exhaustive, and, as a person skilled in the art would understand, other modifications are likely possible. Further, it should not be interpreted that where this has not been done, i.e. where no examples of modifications have been set forth, that no modifications are possible and/or that what is described is the sole physical means of embodying that element of the technology. As a person skilled in the art would understand, this is likely not the case.

Figure 1:
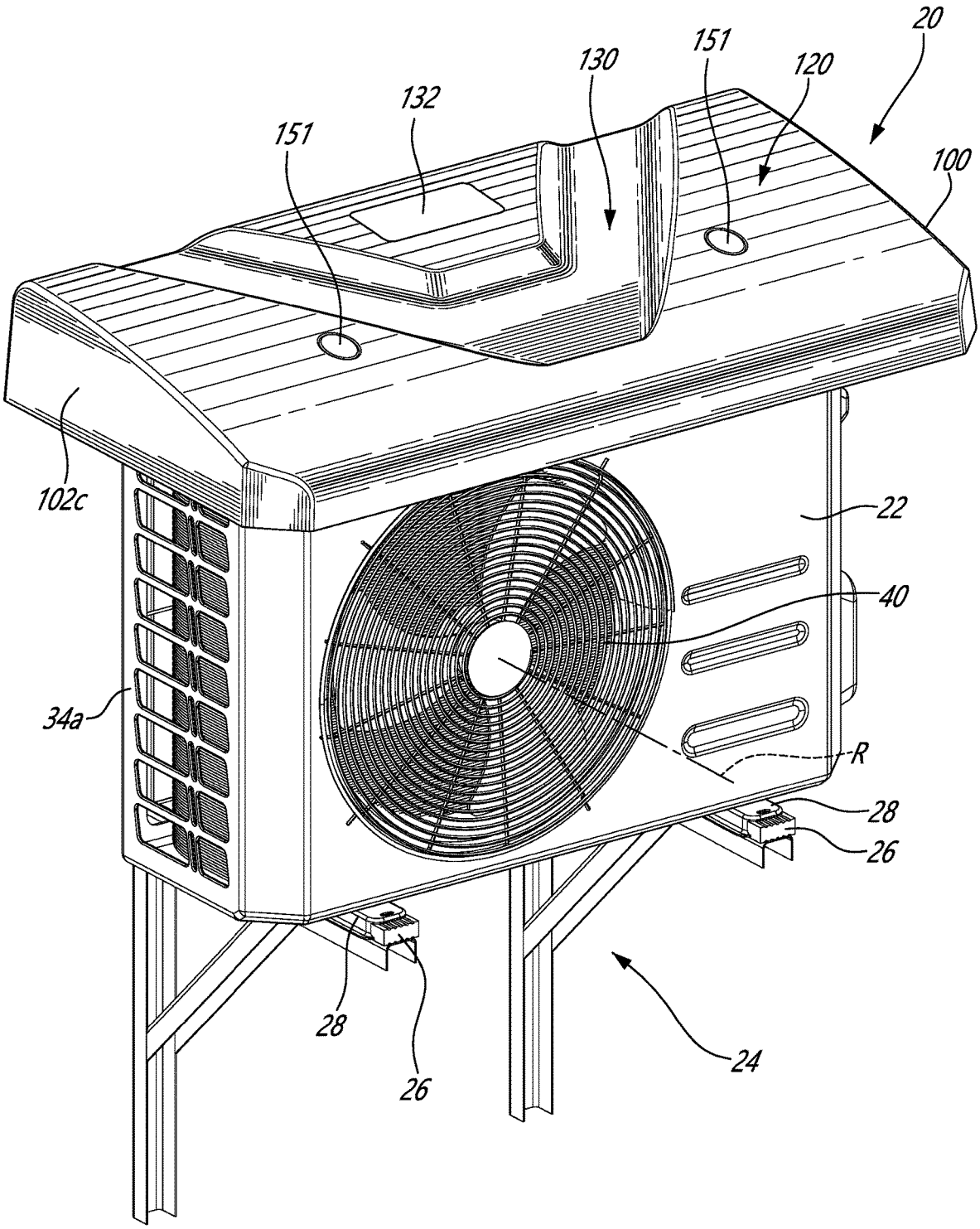
FIG. 1 is a perspective view taken from a top, front, left side of a cover assembly in accordance with one embodiment of the present technology, the cover assembly being installed on a condenser unit mounted to a stand.

Referring to FIG. 1, the cover assembly 20 is adapted for covering at least partially a condenser unit 22. The condenser unit 22 shown in the accompanying FIGS. is an example of a heat pump condenser unit 22. The condenser unit 22 could be of a different size or configuration than the one shown in the FIGS., such as being a condenser unit for an air conditioning system, and the cover assembly 20 could be shaped and configured for a particular design of condenser unit 22, if needed. The shape and configuration of the components and features of the cover assembly 20 about to be described can thus vary from one embodiment of the present technology to another in order to be particularly adapted to the condenser unit that the cover assembly 20 is designed to be fitted to.

The condenser unit 22 is mounted to a stand 24 using a plurality of stand fasteners 26. More particularly, the condenser unit 22 has brackets 28 connected to a bottom wall 30 thereof (FIG. 5), and the brackets 28 are connected to the stand 24 using the stand fasteners 26, which are bolts and nuts in the present embodiment. In the FIGS., the stand 24 is adapted for mounting the condenser unit 22 to a vertical wall 29 shown schematically in FIG. 6A. The stand 24 is therefore a wall mounting bracket. However, it is contemplated that the stand 24 could have a plurality of legs for supporting the condenser unit 22 on a flat, level surface. Other configurations of the stand 24 are contemplated.

Figure 5:
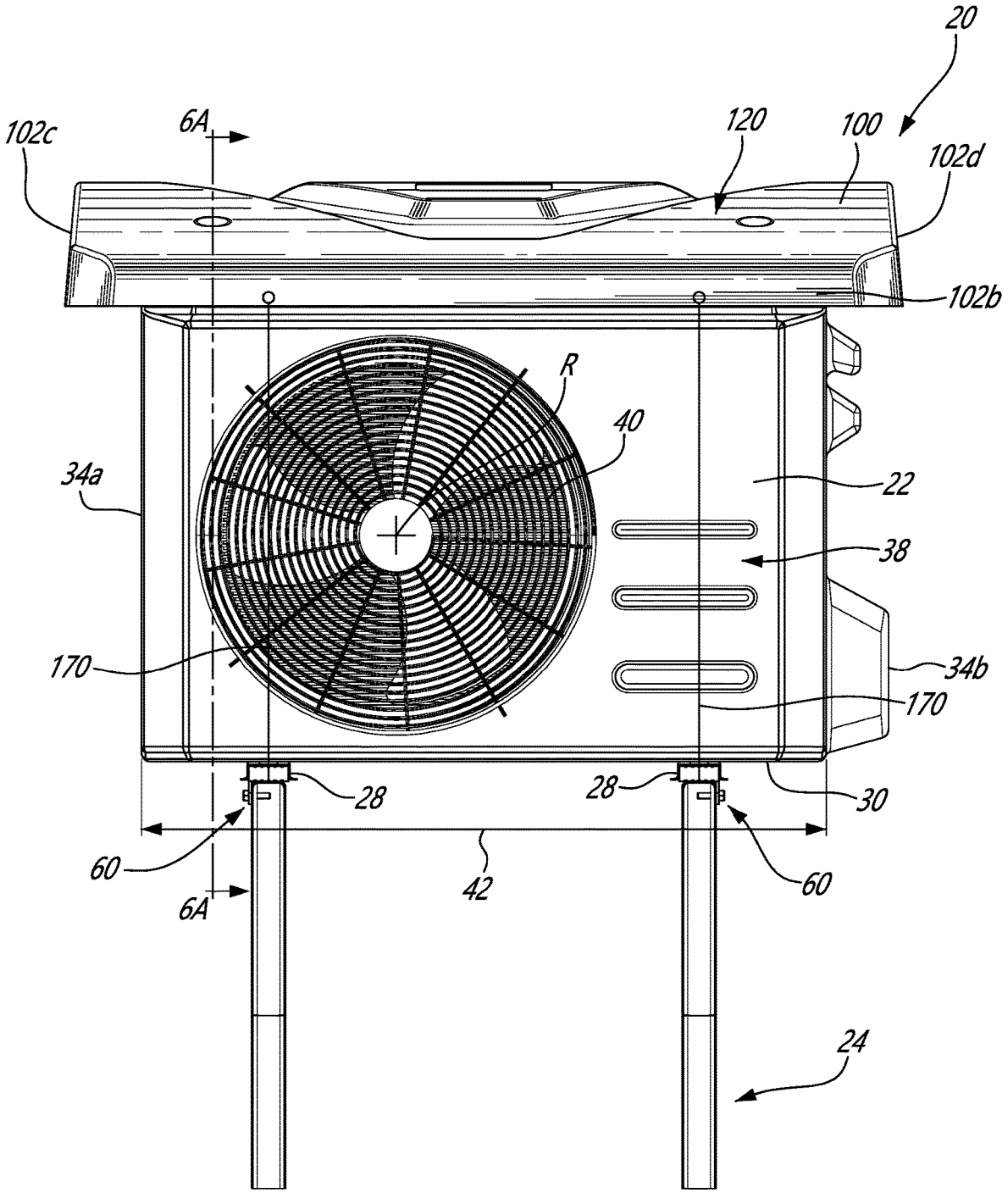
FIG. 5 is a front elevation view of the cover assembly, condenser unit and stand of FIG. 1.
Figure 6A:
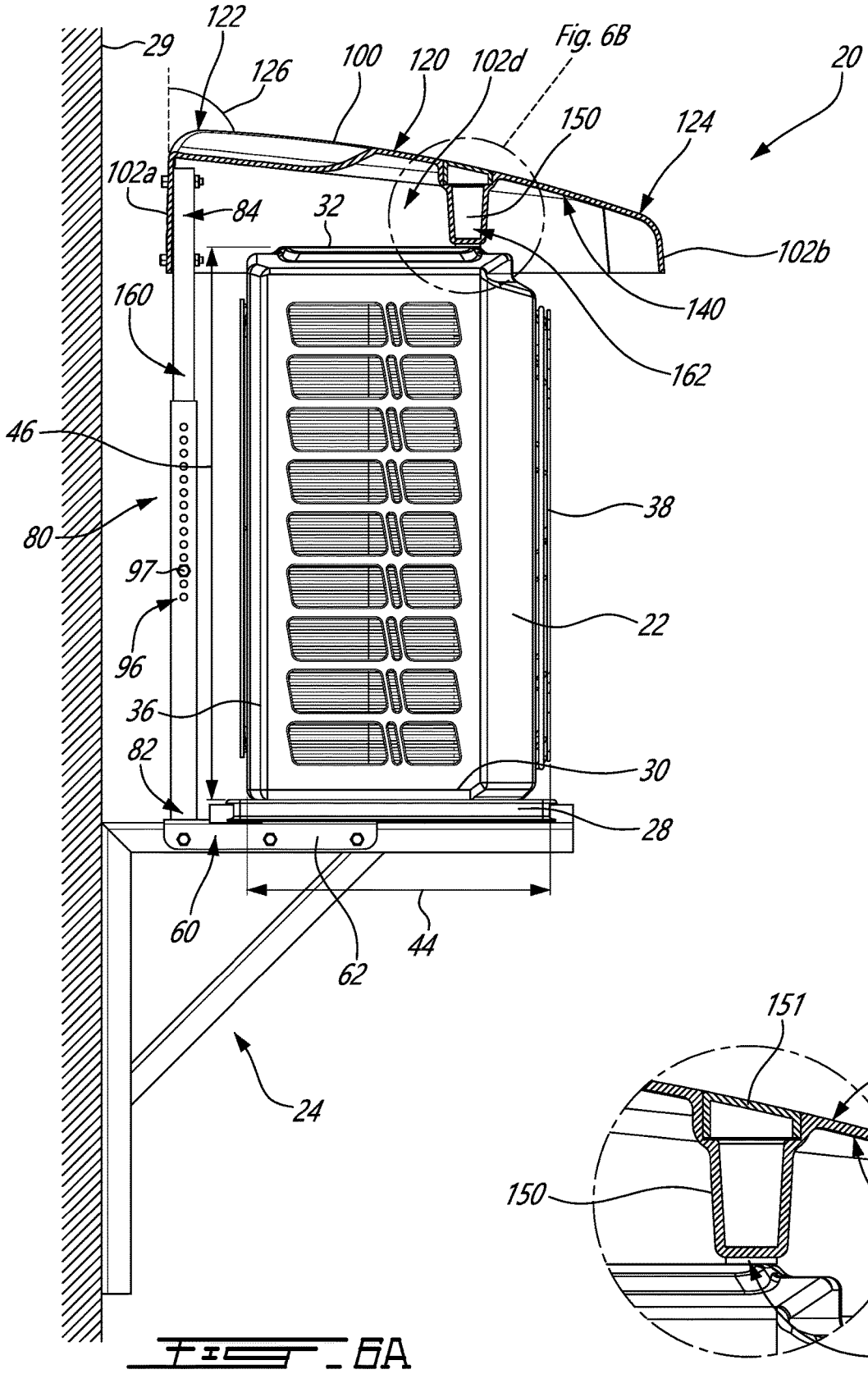
FIG. 6A is a cross-sectional view of the cover assembly, condenser unit and stand of FIG. 5 taken along cross-section line 6A-6A of FIG. 5.
Figure 7:
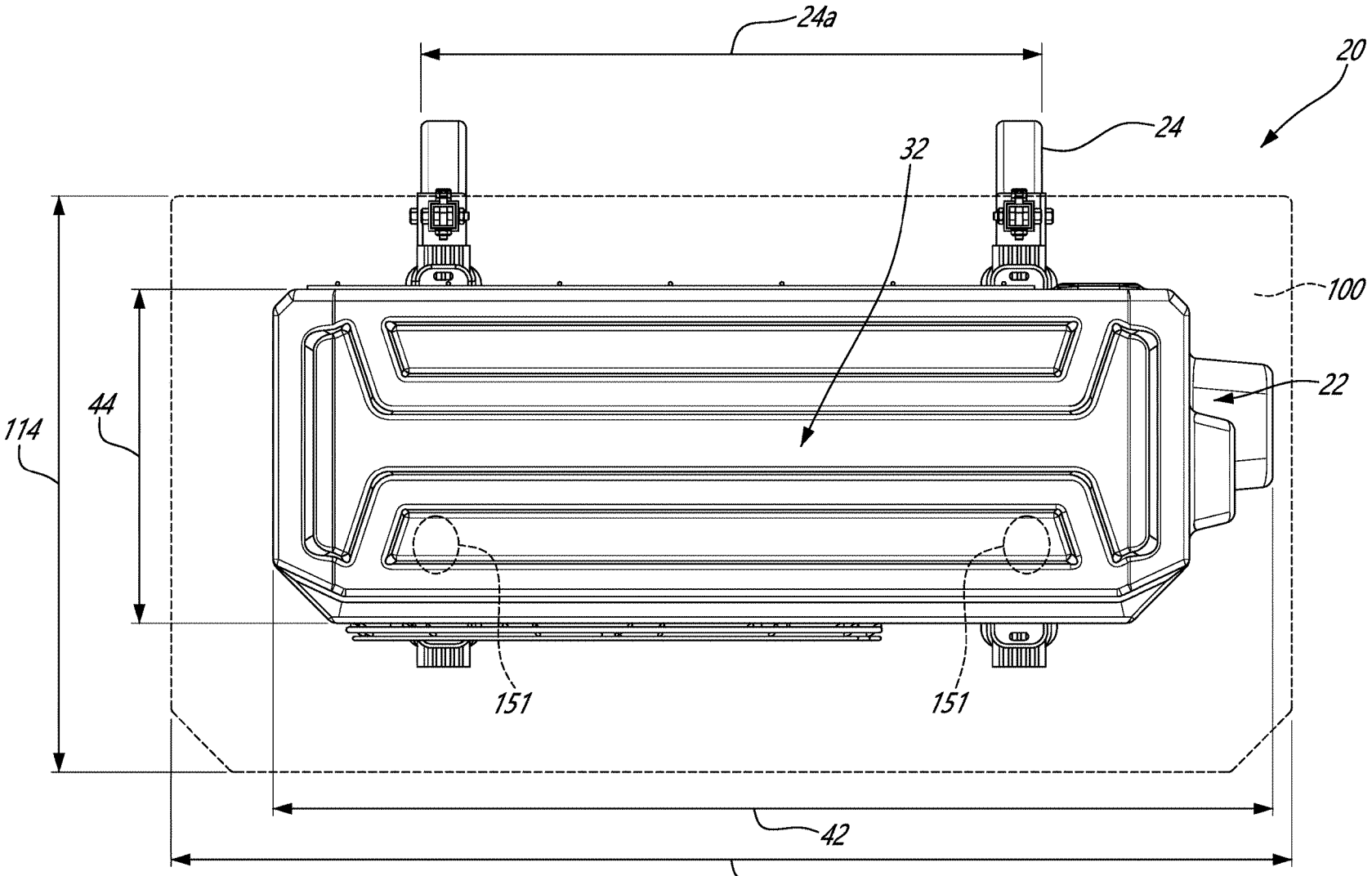
FIG. 7 is a top plan view of the cover assembly, condenser unit and stand of FIG. 1, with the cover shown in transparency.

Referring to FIGS. 1, 5 and 6A, the condenser unit 22 further has a top wall 32, left and right side walls 34*a*, 34*b*, a rear wall 36 and a front wall 38. A fan 40 is provided within the condenser unit 22 to draw air around the condenser (not shown) of the condenser unit 22. Slots and vents are defined in the side walls 34*a*, 34*b*, the rear wall 36 and the front wall 38, to allow air to flow therethrough. The fan 40 is rotatable about a rotation axis R extending generally parallel to the bottom wall 30, the top wall 32 and the side walls 34*a*, 34*b*. The rotation axis R is generally perpendicular to the rear wall 36 and the front wall 38, both of which defining a circular aperture through which air can flow. Referring to FIG. 7, an overall length 42 of the condenser unit 22 is defined between the left side wall 34*a* and the right side wall 34*b*. An overall width 44 of the condenser unit 22 is defined between the rear wall 36 and the front wall 38. An overall height 46 of the condenser unit 22 is defined between the bottom wall 30 and the top wall 32.

Figure 2:
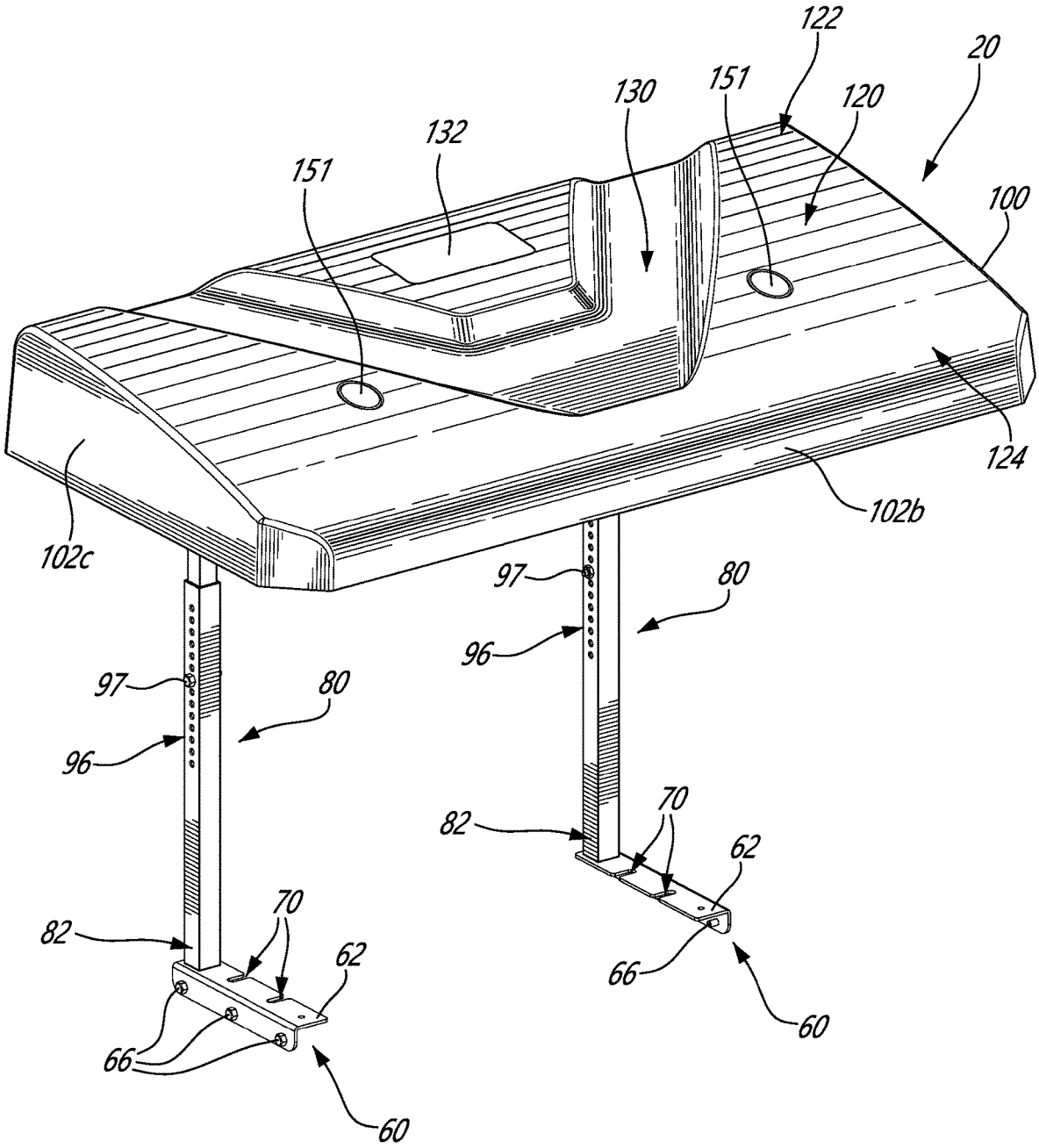
FIG. 2 is a perspective view taken from a top, front, left side of the cover assembly of FIG. 1, without the condenser unit and the stand.
Figure 3:
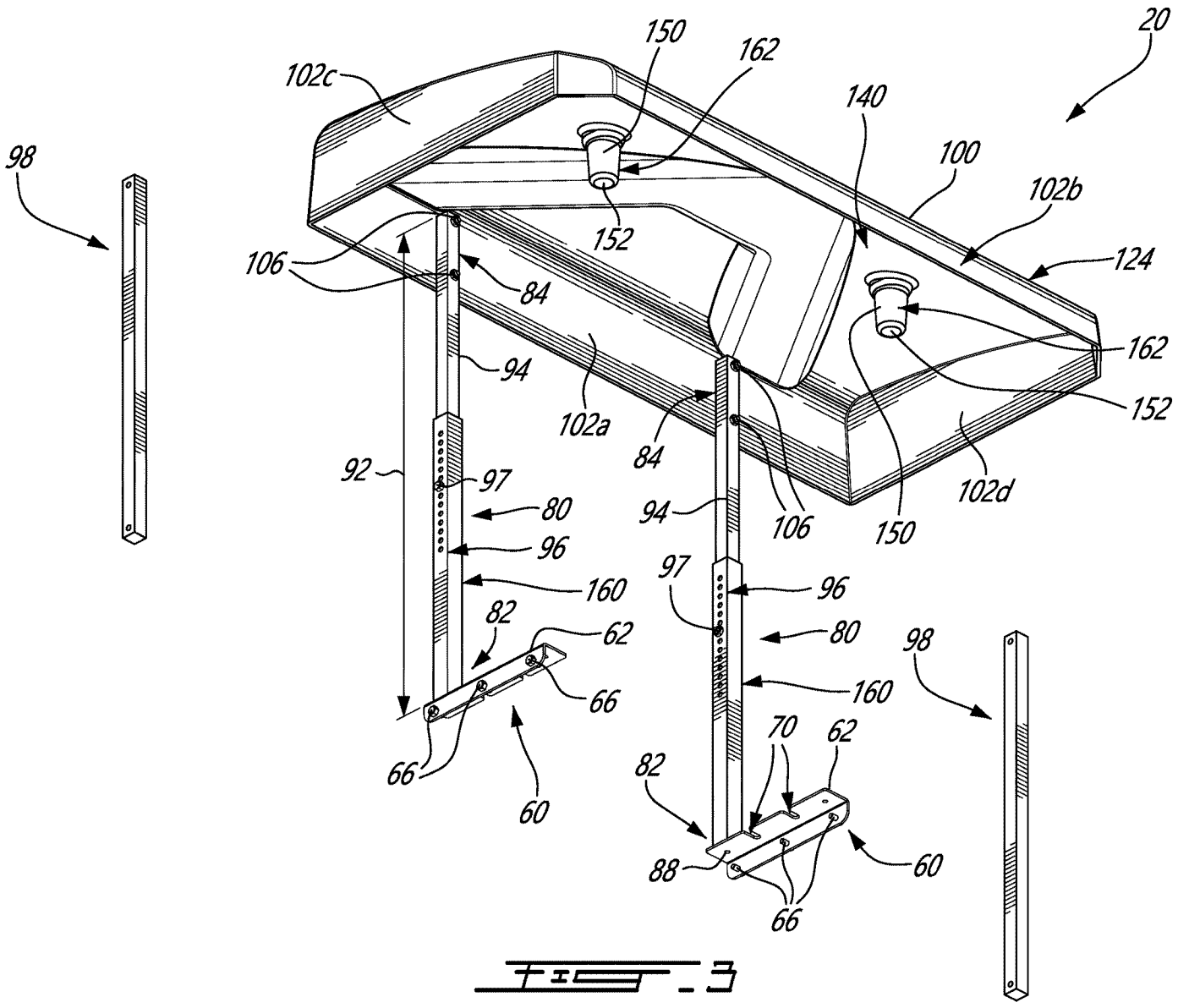
FIG. 3 is a perspective view taken from a bottom, front, left side of the cover assembly of FIG. 2.

Referring to FIGS. 2 to 4, the cover assembly 20 includes a base 60 that is connectable to the stand 24. The base 60 includes two L-shaped members 62 that are sized and configured for mounting to the structure forming the stand 24. In the present embodiment, the L-shaped members 62 are formed by bending sheet metal. The L-shaped members 62 are made of an aluminum alloy, but could be made of other suitable materials. The base 60 could include more or less than two members 62 in other embodiments. Holes are defined in the members 62 for fastening the base 60 to the stand 24 using base fasteners 66. Although bolts are shown in the accompanying FIGS. as being the base fasteners 66, other base fasteners 66 could be used to connect the base 60 to the stand 24. Slots 70 are also defined in the members 62. Fasteners (not shown) connecting the condenser unit 22 to each one of the brackets 28 are receivable within the slots 70. Therefore, the base 60 can be installed on the stand 24 and connected thereto notwithstanding the condenser unit 22 being mounted to the stand 24. Put differently, the slots 70 defined in the members 62 of the base 60 allow for the base 60 to be installed and connected to the stand 24 using the base fasteners 66 without having to dismount or disconnect the condenser unit 22 from the stand 24 or the brackets 28 (FIGS. 5 and 6A). This configuration allows for facilitated installation and connection of the base 60 to the stand 24 at least in some circumstances.

Figure 4A:
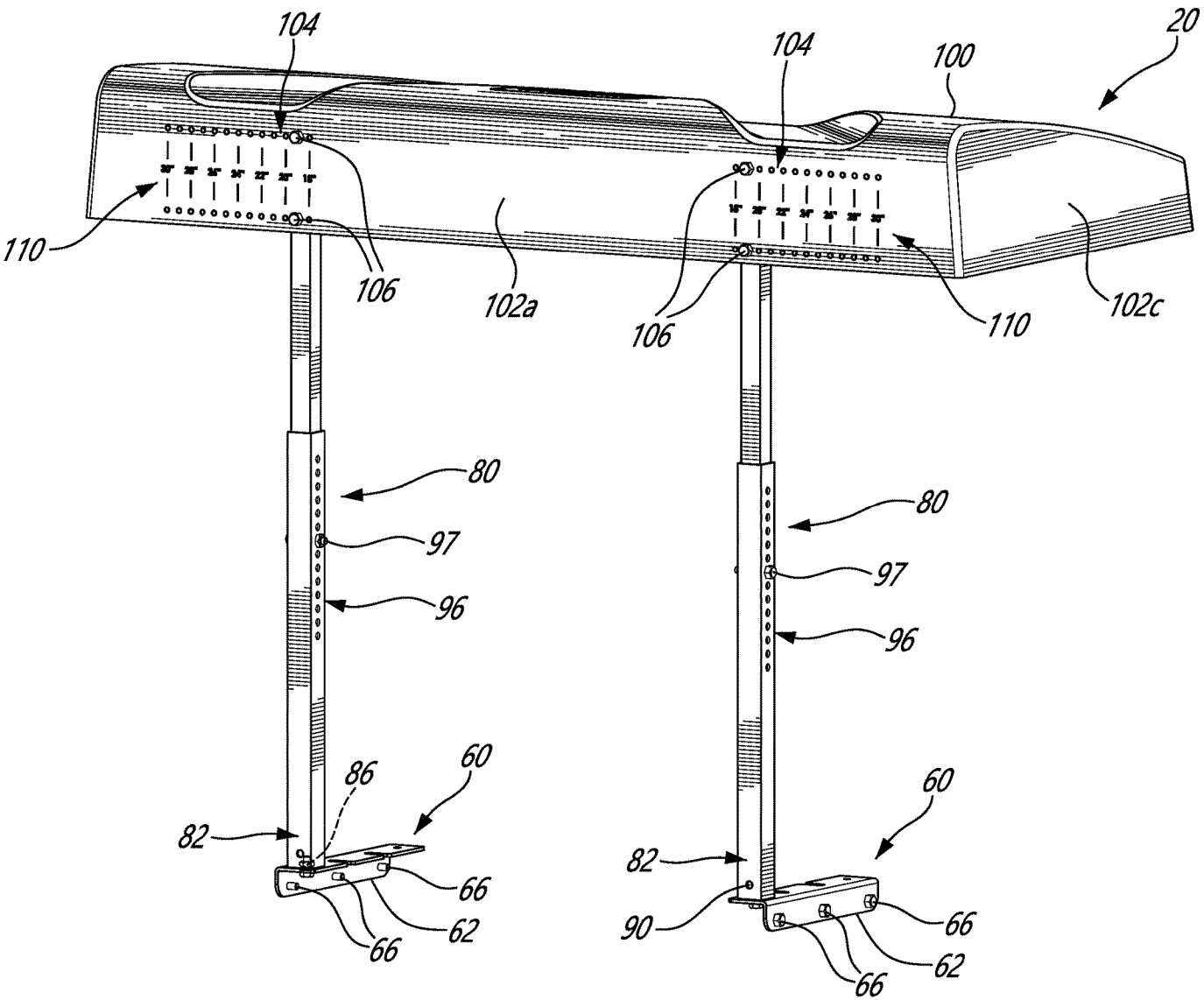
FIG. 4A is a perspective view taken from a top, rear, left side of the cover assembly of FIG. 2.

Referring to FIGS. 2 to 4, the cover assembly 20 further includes two columns 80 extending upwardly from corresponding members 62 of the base 60. It is contemplated that more or less than two columns 80 could be used in other embodiments. The columns 80 extend at the rear of the condenser unit 22, and are spaced from the rear wall 36 and from the adjacent wall 29 (FIG. 6A). This positioning of the columns 80 relative to the condenser unit 22 prevents the columns 80 from touching the condenser unit 22 and causing rattling noises, and provides for convenient access to any one of the side walls 34*a*, 34*b*, the rear wall 36 and the front wall 38. Each column 80 is formed of square tubing made of an aluminum alloy, but could be formed otherwise in other embodiments. Each column 80 has a lower portion 82 and an upper portion 84. The lower portion 82 of each column 80 is connectable to the corresponding member 62 of the base 60 using fasteners 86 (one is shown in FIG. 4A). Holes 88 (one is shown in FIG. 3) are defined in the members 62 of the base 60 and are sized for allowing passage of fasteners 86 therethrough. The fasteners 86 are bolts and nuts. Each column 80 further defines a hole 90 (one is shown in FIG. 4A) for allowing water to drain from the column 80.

The columns 80 are selectively extendable and retractable so as to provide for a selectable height 92 (FIG. 3). A telescopic tube 94 is received within each column 80, and the column 80 and the telescopic tube 94 define a plurality of holes 96 through which a bolt 97 can extend for maintaining the desired height 92 of the column 80. Different components could be used in replacement of the bolt 97, such as spring pins. The telescopic tube 94 could also be frictionally connected to the column 80 via one or more clamps, collars, etc. The holes 96 are spaced at regular intervals, such as 0.5 inch (about 12.7 mm). In the present embodiment, the height 92 of each column 80 can be selected between 21 inches (about 533 mm) and 29 inches (about 737 mm), thus accommodating a wide variety of condenser units 22. For the sake of clarity, each one of the columns 80 of the present embodiment includes the square tubes connected to the corresponding base 60 and the respective telescopic tube 94 received therein. It is contemplated that the columns 80 could be of a fixed height in other embodiments, and that there would be no need for the telescopic tubes 94.

Figure 4B:
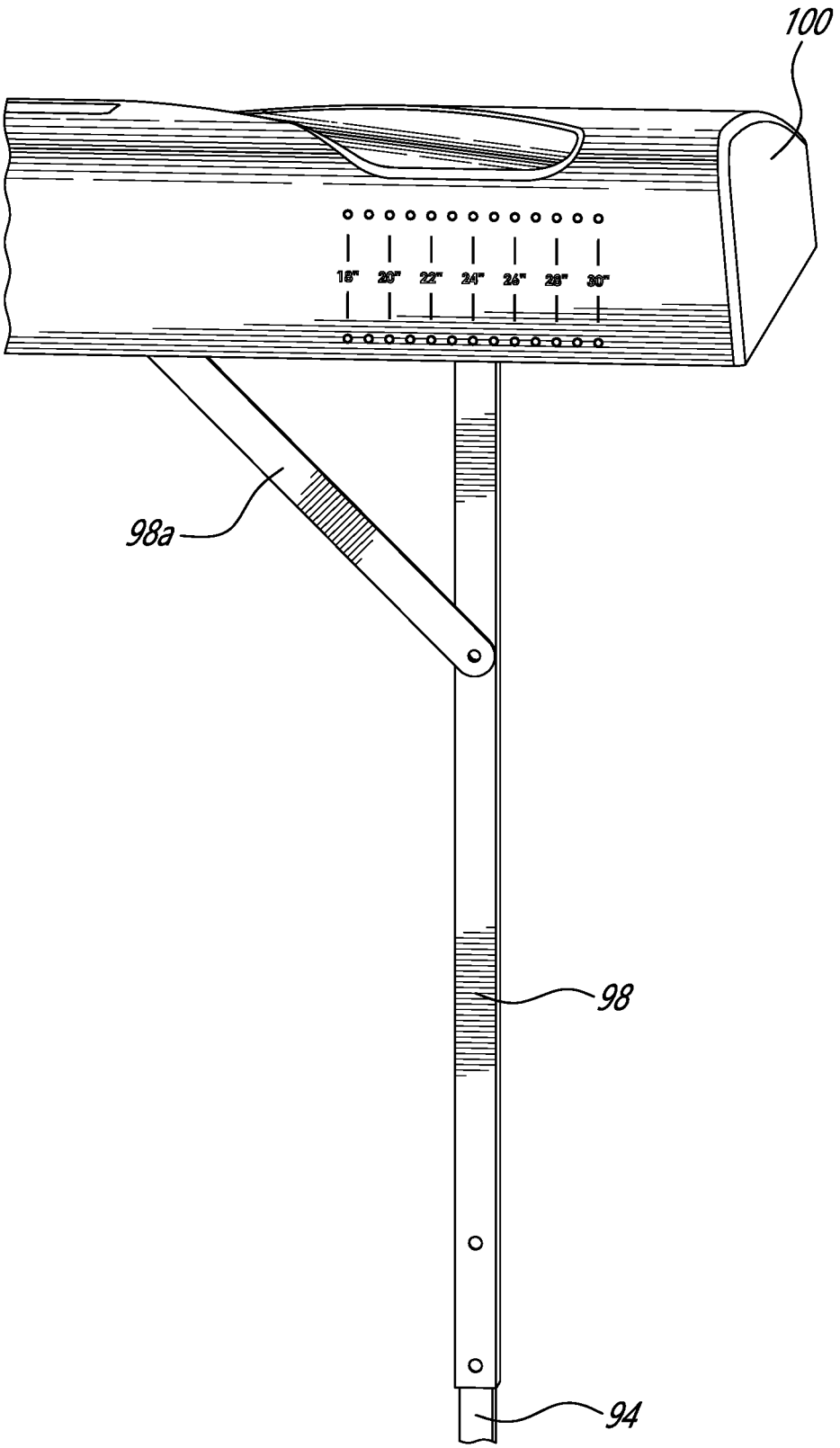
FIG. 4B is a perspective view taken from a top, rear, left side of the cover assembly of FIG. 2, with an extension tube and a brace.

In FIG. 3, two extension tubes 98 are shown. Each extension tube 98 is connectable to one of the telescopic tube 94. The extension tube 98 increases the height 92 of the column 80 and allows the cover assembly 20 to accommodate larger/taller condenser units 22, or stacks of condenser units 22, without the need to provide for different columns 80 and/or telescopic tubes 94. Thus, a kit including one or more extension tubes 98 can be provided separately from the cover assembly 20 in situations where the column 80 and the telescopic tube 94 do not provide for a sufficient height 92. Referring to FIG. 4B, one extension tube 98 is connected to the telescopic tube 94, and a brace 98*a* is connected to the extension tube 98. Put differently, thanks to the configuration of the columns 80, their height 92 adjustment and the possibility of adding one or more extension tubes 98, condenser units 22 of varying heights and arrangements can be accommodated by the cover assembly 20.

Referring to FIGS. 2 to 6A, a cover 100 is connectable to the upper portion 84 of each column 80, which in this embodiment corresponds to the upper portion of each telescopic tube 94 being part of each column 80. More particularly and as best seen in FIGS. 3 and 4, the cover 100 has a rear wall 102*a*, and holes 104 are defined in the rear wall 102*a*. The cover 100 further has a front wall 102*b*, and side walls 102*c*, 102*d* extending between the rear wall 102*a* and the front wall 102*b*. Fasteners 106 extending through the holes 104 are used to connect the cover 100 to the upper portion 84 of each column 80. Measurement markings 110 are provided on the rear wall 102*a* of the cover 100. The measurement markings 110 may be embossed or stamped on the rear wall 102*a*, or provided on stickers applied to the rear wall 102*a* of the cover 100. The measurement markings 110 allow for selective positioning of the cover 100 relative to the columns 80. The measurement markings 110 can thus be used for centering the cover 100 relative to the condenser unit 22. This feature may assist in facilitating installation of the cover assembly 20, at least in some circumstances. The holes 104 and the measurement markings 110 are configured for facilitating the installation of the cover assembly 20 on the stand 24 having a width 24*a* (FIG. 7) ranging between 18 inches (about 457 mm) and 30 inches (about 762 mm). Other embodiments of the cover 100 could be made for condenser units 22 being of different dimensions.

Referring to FIGS. 1, 5 and 6A, when connected to the columns 80, the cover 100 extends above the condenser unit 22 and is shaped and dimensioned for spanning over the condenser unit 22. Referring to FIG. 7, the cover 100 has a length 112 that is greater than the length 42 of the condenser unit 22. The length 112 is about 6 inches (about 152 mm) greater than the length 42, but could differ in other embodiments. In the present embodiment, the length 112 is 37 inches (about 940 mm). The cover 100 also has a width 114 that is greater than the width 44 of the condenser unit 22. The width 114 is 19 inches (about 483 mm). The cover 100 thus spans over more than the entire overall length 42 and the entire overall width 44 of the condenser unit 22 in order to shelter advantageously the condenser unit 22 from rain, snow, icy rain, hail, debris, etc. that could hit the condenser unit 22. It is contemplated that the cover 100 could have a larger length 112 of 43 inches (1092 mm) and a width 114 of 21 inches (533 mm). Referring to FIGS. 5 and 6A, the rear wall 102*a*, the front wall 102*b*, and the side walls 102*c*, 102*d* extend vertically lower than the top wall 32 of the condenser unit 22 to enhance the protection provided by the cover 100. Put differently, the cover 100 "sits" on top of the condenser unit 22 similar to a hat on one's head. In the present embodiment, the rear wall 102*a*, the front wall 102*b*, and the side walls 102*c*, 102*d* extend vertically lower than the top wall 32 of the condenser unit 22 by about 1 inch (about 25.4 mm).

The cover 100 is made of a polymeric material having a thickness of about ⅛ inch (about 3.2 mm). In the present embodiment, the material is a hexene copolymer, more particularly a linear low-density polyethylene adapted for rotational moulding processes. Having the cover 100 made of polymeric material can reduce the noise caused by rain, hail, icy rain, etc. when hitting the cover 100 compared to other embodiments where the cover 100 could be made of a metallic material. A top face 120 of the cover 100 has a surface finish selected to limit the apparition of scratches, and/or to increase the durability of the cover 100. Referring to FIGS. 2 and 6A, the top face 120 has a rear portion 122 and a front portion 124. The rear portion 122 extends vertically higher than the front portion 124 when the cover 100 is connected to the columns 80. The top face 120 is generally curved downwardly from the rear portion 122 to the front portion 124. An angle 126 defined between the rear wall 102*a* and the top face 120 is greater than 90 degrees, and in the present embodiment is of about 95 degrees. This feature improves drainage water present on the cover 100 and makes the cover 100 more aesthetically pleasing. A V-shaped ridge 130 is defined in the cover 100. The ridge 130 extends over a majority of the length 112 and over a majority of the width 114 of the cover 100. Such a configuration of the ridge 130 increases the structural rigidity of the cover 100. The ridge 130 could have different shapes and configurations in other embodiments. A plate 132 shown in FIGS. 1 and 2 is connected to the top face 120 of the cover 100. The plate 132 could include, for example, a manufacturer's name, model number and/or other markings. The plate 132 facilitates the process of changing a manufacturer's name, model number and/or other markings on covers 100.

Figure 6B:
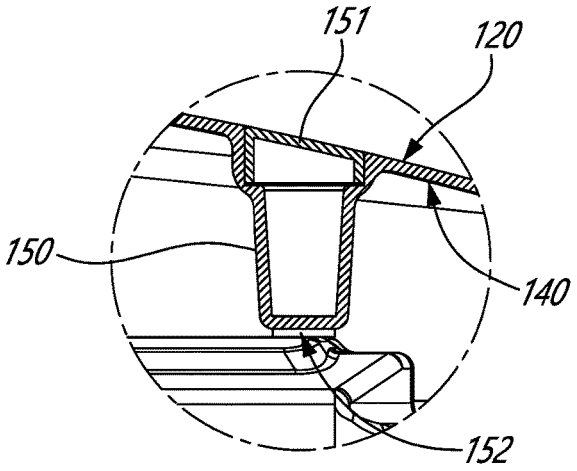
FIG. 6B is an enlarged view of portion 6B of FIG. 6A.

Referring to FIGS. 3, 6A and 6B, the cover 100 further has a bottom face 140 opposite the top face 120. Two legs 150 project downwardly from the bottom face 140 of the cover 100. The legs 150 are integrally formed with the cover 100, but could be provided as separate components connectable to the cover 100 in other embodiments. A cap 151 (FIGS. 1, 2, 6B and 7) covers the recess defined by each leg 150 in the top face 120 of the cover 100. Referring to FIGS. 3 and 6A, the legs 150 are located closer to the front portion 124 of the top face 120 than from the rear portion 122 of the top face 120. The legs 150 abut the top wall 32 of the condenser unit 22 and are spaced from the columns 80. The legs 150 could be configured differently in other embodiments, and could be shaped and configured to abut any one of the left and right side walls 34*a*, 34*b*, the rear wall 36 and the front wall 38 of the condenser unit 22, whether alone or in combination. More or less than two legs 150 could be used in other embodiments. In order for the cover 100 to "sit" on top of the condenser unit 22 as described above, each leg 150 extends vertically higher than a bottom edge of any one of the rear wall 102*a*, the front wall 102*b*, and the side walls 102*c*, 102*d* of the cover 100.

Referring to FIGS. 3 and 6B, a fastener 152 is connected to each leg 150 for connecting each leg 150 to the top wall 32 of the condenser unit 22. The fastener 152 prevents the leg 150 and the top wall 32 from causing rattling noises in certain circumstances, such as when the fan 40 is in operation. The fastener 152 is a magnet that sticks the leg 150 to the top wall 32 of the condenser unit 22. Different types of fasteners could be used, such as double-side adhesive tape, an adhesive, hook and loop fastener, etc. It is to be noted that using such fasteners 152 do not require drilling or altering the top wall 32 of the condenser unit 22. Thanks to the fastener 152, each leg 150 is connected to the top wall 32 of the condenser unit 22 and provide for additional support of the cover 100. For example, should the cover 100 have a load applied on the top face 120 (caused by snow accumulation, for example), the load is spread between the two legs 150 and the two columns 80, and the load is then transferred from the cover 100 to the stand 24 through the columns 80, and from the cover 100 to the enclosure of the condenser unit 22 through the legs 150. Put differently and referring to FIGS. 3 and 6A, each column 80 defines a load path 160, and each leg 150 defines a load path 162 being different from the load path 160. There are thus four load paths: two load paths 160 for transferring the load from the cover 100 to the stand 24 via the columns 80, and two load paths 162 for transferring the load from the cover 100 to top wall 32 of the enclosure of the condenser unit 22. The different load paths 160, 162 may allow the cover assembly 20 to withstand greater loads than other cover assemblies, and ensuring stability and durability of the cover 100 extending above the condenser unit 22.

Referring to FIG. 5, tethers 170 (only shown in FIG. 5) are connected between the front wall 102*b* of the cover 100, and the stand 24. The tethers 170 extend in front of the front wall 38 of the condenser unit 22. The tethers 170 are formed of metallic cables, but could be straps made of fabric. When tensioned, the tethers 170 may assist the fasteners 152 in keeping the legs 150 abutted to the top wall 32 in some circumstances, such as during strong gusts of wind. The tethers 170 could be connected using bolts or eyelets provided on the cover 100 and/or the stand 24. Other configurations of the tethers 170 are contemplated.

Figure 8:
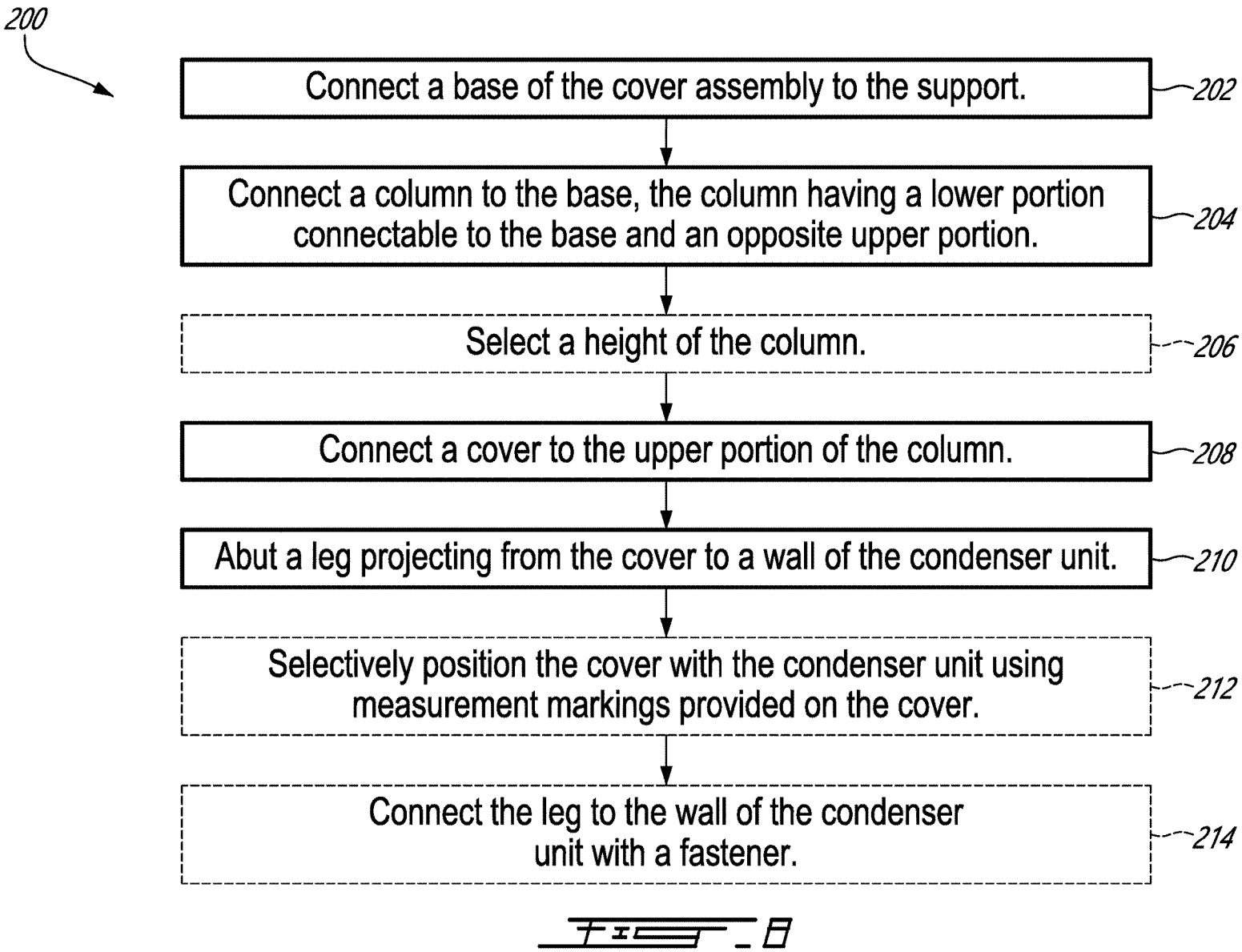
FIG. 8 is a flowchart of a method for installing a cover assembly on a condenser unit mounted to a stand in accordance with one embodiment of the present technology.

Referring to FIG. 8, a method 200 for installing the cover assembly 20 on the condenser unit 22 mounted to the stand 24 will be described. At step 202, the method 200 involves connecting the two bases 60 to the stand 24. It is reminded that, in the present embodiment, there is no need to dismount or disconnect the condenser unit 22 from the stand 24 to connect the two bases 60 using the base fasteners 66. At step 204, each of the two columns 80 has the lower portion 82 thereof connected to a corresponding base 60. At step 206, the height 92 of the columns 80 is selected. The step 206 is optional and could be omitted in some embodiments. In addition, if needed, one or more extension tubes 98 is connected to the columns 80 to obtain the desired height 92. At step 208, the cover 100 is connected to the upper portion 84 of each column 80 using fasteners 106. At step 210, which can occur simultaneously with step 208, the two legs 150 abut the top wall 32 of the condenser unit 22, and define the load paths 162 that are spaced from the load paths 160 defined by the columns 80. At optional step 212, the cover 100 is selectively positioned (for example, centered) with the condenser unit 22 using the measurement markings 110 provided on the rear wall 102*a* of the cover 100. At optional step 214, each leg 150 is connected to the top wall 32 of the condenser unit 22 with the fastener 152. The steps of the method 200 can occur in the order presented above, or in any other order that is deemed better suited for a particular installation.

Referring back to FIG. 6A, it is to be noted that since the cover assembly 20 does not connect to the wall 29 adjacent the condenser unit 22, installation is facilitated as there is no need for installing anchors on the adjacent wall 29 for supporting the cover assembly 20. In addition, air can flow between the rear wall 102*a* of the cover 100 and the adjacent wall 29, thus limiting the airflow restrictions that may be caused by the cover assembly 20 compared to other cover assemblies. Furthermore, should the condenser unit 22 be accessed for maintenance, the cover 100 is conveniently removable from the columns 80 upon unfastening the fasteners 106, or upon separation of the telescopic tubes 94 from the columns 80 in the present embodiment. Moreover, in some circumstances, the cover assembly 20 could be uninstalled from a condenser unit 22 and stand 24 having given dimensions/configuration, and be re-installed on a condenser unit 22 and stand 24 being of different dimensions/configuration thanks to the adjustability in height of the columns 80 and to the plurality of holes 104 defined in the cover 100 for connecting the columns 80 thereto.

The embodiments described in this document provide non-limiting examples of possible implementations of the present technology. Upon review of the present disclosure, a person of ordinary skill in the art will recognize that changes may be made to the embodiments described herein without departing from the scope of the present technology.

What is claimed is:

1. A cover assembly for a condenser unit mounted to a stand, comprising:

a base connectable to the stand;

a column extending upwardly from the base, the column having a lower portion and an opposite upper portion, the lower portion being connectable to the base;

a cover connectable to the upper portion of the column, the cover extending above the condenser unit, the cover spanning at least partially over the condenser unit;

a leg projecting from the cover, the leg being abuttable to a wall of the condenser unit, the leg being spaced from the column; and the column defining a first load path between the cover and the stand, the leg defining a second load path between the cover and the condenser unit, and the second load path being different from the first load path.

2. The cover assembly of claim 1, wherein the column extends at the rear of the condenser unit.

3. The cover assembly of claim 1, wherein the leg is integrally formed with the cover.

4. The cover assembly of claim 1, wherein the cover has a bottom face, and the leg projects downwardly from the bottom face of the cover.

5. The cover assembly of claim 1, wherein:

the wall of the condenser unit is a top wall of the condenser unit; and the leg is abuttable to the top wall of the condenser unit.

6. The cover assembly of claim 5, wherein the cover has at least one side wall extending vertically below the top wall of the condenser unit.

7. The cover assembly of claim 1, further comprising a fastener connectable to the leg for connecting the leg to the wall of the condenser unit.

8. The cover assembly of claim 7, wherein the fastener is one of a double-sided adhesive tape, an adhesive, a hook and loop fastener, and a magnet.

9. The cover assembly of claim 1, wherein the base defines at least one slot, and the cover assembly further comprises a base fastener receivable in the at least one slot, the base fastener connecting the base to the stand notwithstanding the condenser unit being mounted to the stand.

10. The cover assembly of claim 1, further comprising measurement markings provided on the cover for selectively positioning the cover relative to the condenser unit.

11. The cover assembly of claim 1, wherein the cover has a top face having a rear portion and a front portion, the rear portion extending vertically higher than the front portion when the cover is connected to the column, and the top face is generally curved downwardly from the rear portion to the front portion.

12. The cover assembly of claim 1, wherein the cover defines at least one ridge extending over at least one of a majority of a length of the cover and a majority of a width of the cover.

13. The cover assembly of claim 1, wherein the cover is shaped and dimensioned to span over at least one of an entire overall length and an entire overall width of the condenser unit.

14. The cover assembly of claim 1, wherein the column has a selectively adjustable height.

15. The cover assembly of claim 1, further comprising at least one extension tube connectable between the column and the cover.

16. A method for installing a cover assembly on a condenser unit mounted to a stand, the method comprising the steps of:

connecting a base of the cover assembly to the stand;

connecting a column to the base, the column having a lower portion connectable to the base and an opposite upper portion;

connecting a cover to the upper portion of the column; and abutting a leg projecting from the cover to a wall of the condenser unit.

17. The method of claim 16, further comprising connecting the leg to the wall of the condenser unit with a fastener.

18. The method of claim 16, further comprising selecting a height of the column prior to connecting the cover to the upper portion of the column.

19. The method of claim 16, further comprising selectively positioning the cover with the condenser unit using measurement markings provided on the cover.

20. The method of claim 16, further comprising connecting at least one extension tube between the column and the cover.

* * * * *